US005816417A

United States Patent [19]

Reaves

[11] Patent Number: 5,816,417

[45] Date of Patent: Oct. 6, 1998

[54] MINI CLOTHES LINE

[76] Inventor: Joan Marie Reaves, 6318 Bridgehampton Dr., New Orleans, La. 70126

[21] Appl. No.: 871,782

[22] Filed: Jun. 11, 1997

[51] Int. Cl.[6] ..... D06F 53/00

[52] U.S. Cl. ..... 211/119.01; 211/180; 160/127

[58] Field of Search ..... 211/119.01, 119.1, 211/180; 160/46, 52, 58.1, 127; 248/910, 346.2

[56] References Cited

U.S. PATENT DOCUMENTS

| | | | |
|---|---|---|---|
| 2,407,959 | 9/1946 | Littlejohn | 211/119.18 |
| 2,459,110 | 1/1949 | Midouhas . | |
| 2,558,410 | 6/1951 | Andersen | 211/119.01 |
| 3,139,190 | 6/1964 | Shore . | |
| 3,857,493 | 12/1974 | Bourne . | |
| 5,020,764 | 6/1991 | Yamamoto | 248/910 X |
| 5,112,023 | 5/1992 | Sowers | 248/910 X |
| 5,280,841 | 1/1994 | Van Deursen . | |
| 5,354,031 | 10/1994 | Bilotti | 248/910 X |
| 5,372,266 | 12/1994 | Fisher | 211/119.01 X |

FOREIGN PATENT DOCUMENTS

| | | | |
|---|---|---|---|
| 654331 | 6/1963 | Italy | 211/119.01 |
| 61-398 | 1/1986 | Japan | 211/119.01 |
| 3040598 | 2/1988 | Japan | 211/119.01 |

*Primary Examiner*—Blair Johnson
*Attorney, Agent, or Firm*—Kenneth L. Tolar

[57] ABSTRACT

The present invention relates to a new and improved clothes line assembly having integrated means for concealing clothing hanging thereon. Privacy screens are received within a top frame section and may be pulled down providing an enclosure. The invention is supported by hollow base members that may be filled with sand or a similar weighted material providing stabilization to the assembly. The weighted material may be removed allowing the assembly to be easily and inexpensively moved or shipped.

10 Claims, 3 Drawing Sheets

MINI CLOTHES LINE

BACKGROUND OF THE INVENTION

The present invention relates to a new and improved clothes line device that is easy to move or transport and which can be enclosed for privacy. The device is supported by a pair of hollow, substantially L-shaped base members which can be filled with sand for stabilization. A pair of legs are vertically received within each base member and are attached to three separate tubular sections. The tubular sections form a three-sided upper frame that is attached to a four sided, substantially square lower frame. A plurality of clothes lines are attached in parallel to two opposing sides of the bottom frame. A scroll type spring-loaded privacy screen is received within each tubular section allowing hanging garments to be concealed from public view. The screens may also be secured to the base members preventing the screens from blowing uncontrollably in the wind.

DESCRIPTION OF THE PRIOR ART

Clothes line devices currently in use are openly exposed meaning that undergarments and other potentially embarrassing clothing hanging thereon are in plain view for neighbors or other passers by to see. Accordingly, there is a need for a clothes line device that can be quickly and easily enclosed thereby concealing clothes from public view.

Furthermore, the devices currently in use are generally cumbersome to set up or remove. They are generally supported by a large heavy base member or alternatively they are anchored to the ground. The anchor type devices are susceptible to being knocked down by wind or other external forces.

The devices that are supported by a heavy base member are generally difficult to move and expensive to ship. The present invention can be selectively weighted by filling the base members with sand or a similar material. This feature allows the device to be converted to a lightweight assembly that can be easily and inexpensively shipped or transported. The present invention is designed to provide additional benefits that are not currently present in any of the prior art devices as more fully described below.

U.S. Pat. No. 2,459,110 issued to Midouhas discloses a collapsible clothes line having parallel lines that can be turned to a position parallel with the sun's rays. The clothes line's supporting arms each have a central pivot which facilitates the extension of the arms from the folded vertical position to the horizontal extended position.

U.S. Pat. No. 3,139,190 issued to Shore discloses a collapsible clothes line dryer which has a plurality of arms that swing horizontally about a vertical post. These arms are attached to each other and basically form an X-shaped frame. A pair of hangers are mounted on the arms such that they are substantially parallel. Each hanger has a plurality of slots for receiving clothes lines. A single length of clothes line is used and passed through each slot alternating between each hanger such that the single clothes line forms a plurality of parallel clothes lines. The means for attaching the single line in this manner eliminates the need to tie individual knots at each end of the parallel clothes lines.

U.S. Pat. No. 3,857,493 issued to Bourne relates to a collapsible garment dryer comprising a post with radially extending arms that may be collapsed as desired. The device is stabilized by anchoring the post into the ground.

U.S. Pat. No. 5,280,841 issued to Van Deursen discloses a portable clothes dryer support assembly adapted for mounting on a pole. The device has a set of arms that extend radially from a centrally located collar. The arms extend upward at approximately a 45 degree angle to define a cone-shaped assembly that can easily be collapsed as desired. As indicated above, none of the above described inventions provide a means for concealing clothes that are hanging on a clothes line. Furthermore, none of these inventions provide a base support member that can effectively stabilize a clothes line device while being convertible to a lightweight assembly that can be easily and inexpensively moved, packed and/or shipped.

SUMMARY OF THE INVENTION

The present invention provides a new and improved clothes line assembly that may be selectively weighted when in use and may be enclosed to conceal clothes hanging thereon. It is therefore an object of the invention to provide a new and improved clothes line assembly that can be quickly and easily erected or disassembled.

It is a further object of the present invention to provide a new and improved clothes line assembly that can provide privacy so that clothes hanging thereon are concealed from the general public.

It is yet a further object of the present invention to provide a new and improved clothes line assembly that can be stabilized without the use of a heavy base member or without anchoring to the ground.

It is still a further object of the present invention to provide a new and improved clothes line assembly that can be stabilized with base members that can be quickly, easily and inexpensively removed or shipped.

Other objects, features and advantages of the present invention and its details of construction and arrangement of parts will be seen from the following description of the preferred embodiments when considered with the attached drawings and from the appended claims.

DESCRIPTION OF THE PREFERRED EMBODIMENT

Figure 1:
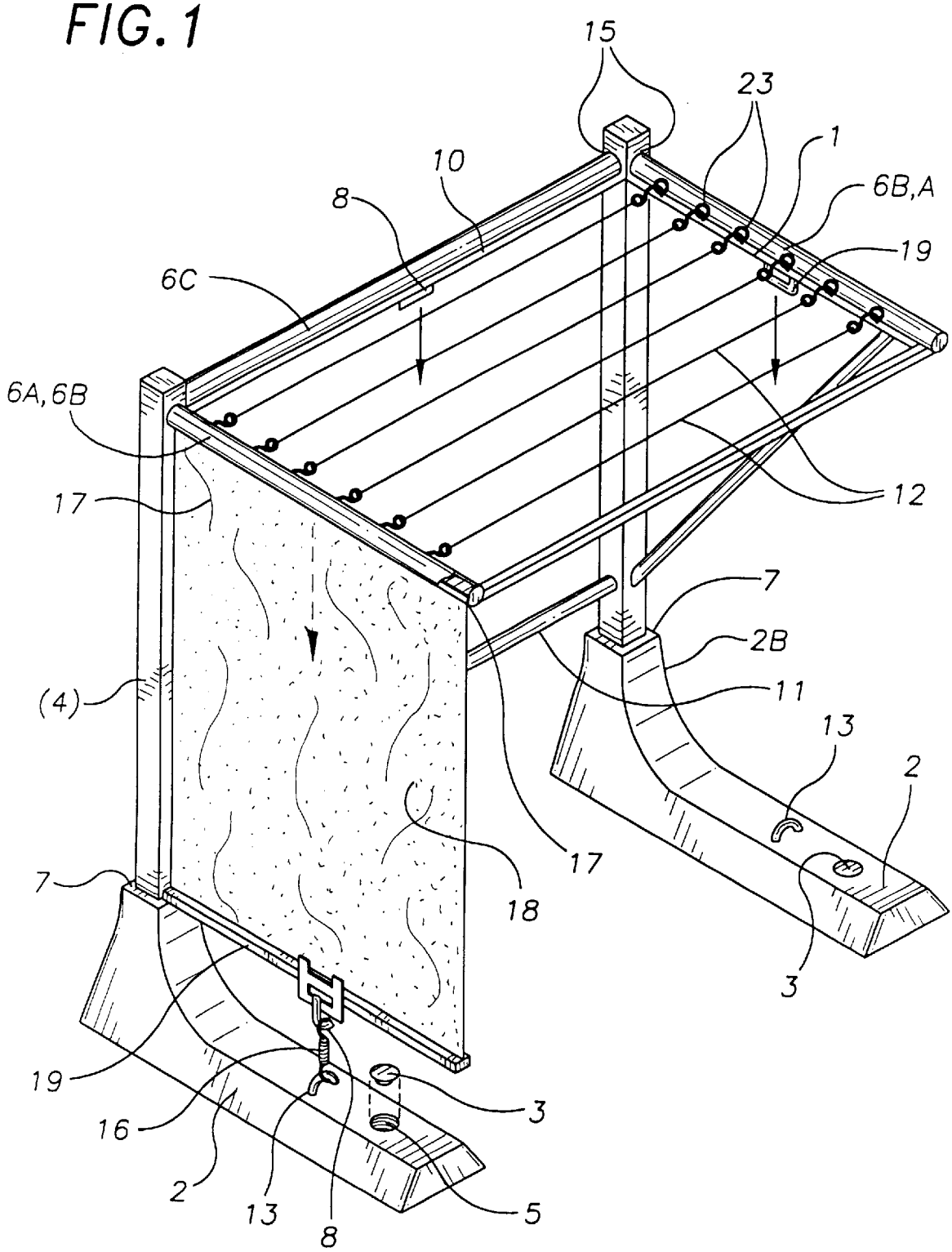
FIG. 1 generally depicts the invention and the accompanying pull down privacy screens.
Figure 2:
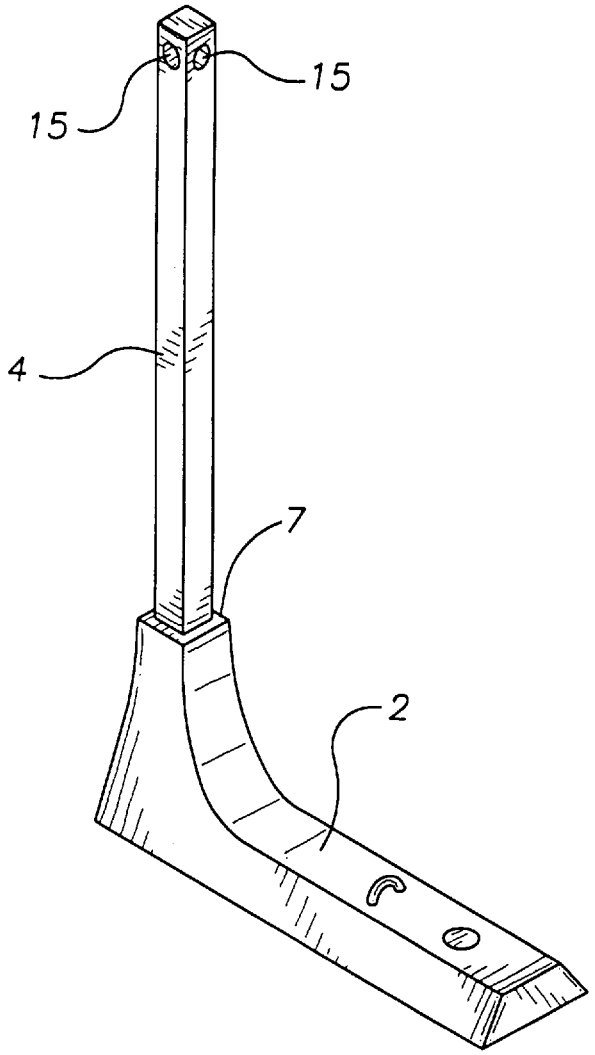
FIG. 2 shows an L-shaped base member attached to a leg support.
Figure 4:
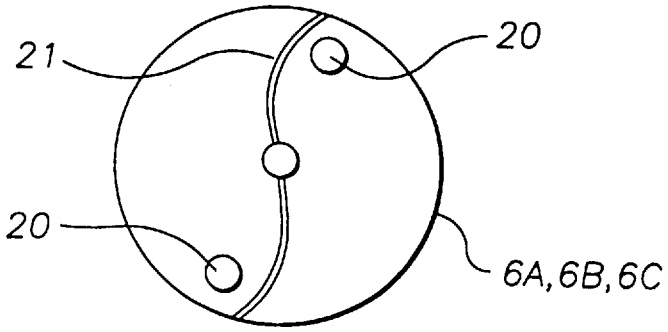
FIG. 4 depicts a cross-sectional view of the spring loaded screen deployment mechanism used in rolling the privacy screens up or down.
Figure 3:
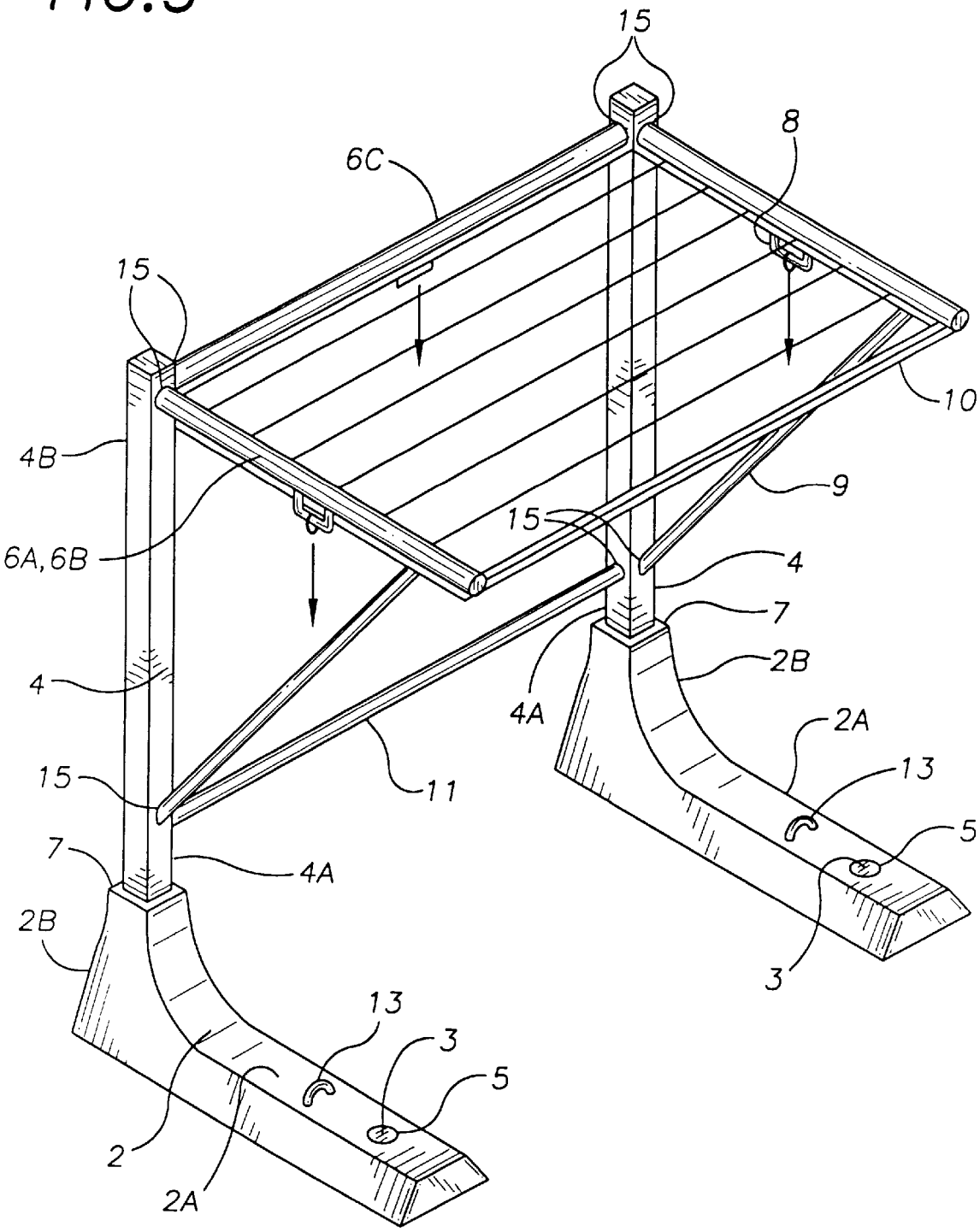
FIG. 3 depicts the device with the screens in the rolled up position.

Referring now to FIGS. 1–4, there is generally shown a mini clothes line assembly with integrated roll-up/roll-down privacy screens. The mini clothes line assembly comprises a pair of hollow substantially L-shaped base members 2. The members are substantially parallel and each 2 has a substantially flat portion 2A. The hollow portion defines a chamber for receiving sand or a similar heavy material. On the top exterior of the substantially flat portion of the L-shaped base members 2 is an integrally molded hook 13 and another aperture 5 which receives a cap 3. The cap may be removed allowing sand to be poured into the chamber to weight and stabilize the device when in use. Furthermore, the sand may be removed as desired allowing the base members to be easily moved or transported.

The hollow base members further comprise an upwardly extending portion 2B. Each of the upwardly extending portions has an aperture 7. A pair of substantially square legs 4 each having a first 4A and a second end 4B and four sides are vertically received within the apertures 7 by inserting the first end 4A therein. Each of the legs 4 has a pair of circular holes 15 at each end. A pair of holes 15 at one end are positioned on different but adjacent sides with a matching, diametrically opposed pair at the other end. The legs 4 are placed in the apertures 7 and aligned such that a hole 15 at each end of one leg is in apostion with a hole at each end of the other leg. Each of the other two pairs of holes are facing in substantially the same direction. The holes 15 at each end lie in substantially the same horizontal plane with respect to the holes at the same end on the other leg.

Three hollow tubular sections 6A, 6B and 6C are attached to each of the legs 4 by inserting an end into each of the holes 15 as shown in FIG. 1. The tubular sections 6A, 6B and 6C form a three sided upper frame with two sides substantially parallel 6A and 6B which are substantially perpendicular to a third side 6C.

A second substantially square bottom frame 10 is attached to the underside of each tubular section 6A, 6B and 6C using conventional attachment means such a screws, bolts or tie-wires. The second bottom frame 10 has two cross support legs 9 extending downwardly at an angle. The cross support legs 9 extend diagonally with respect to the vertical plane formed by a base member 2, its corresponding leg 4 and a parallel tubular section 6A, 6B. The cross support legs 9 attach at an end to the first and second tubular sections 6A, 6B by inserting each into a pair of similarly facing holes on the legs 4 proximal to the first end 4A. A separate horizontal cross support member 11 is received within each of the apositioned holes proximal the first ends 4A of the legs 4.

Received within each tubular section 6A, 6B and 6C is a scroll type screen 17. Each scroll type screen 17 has a stiffener 19 which extends through a longitudinal slot 1 on each of the tubular sections 6A, 6B and 6C. Centrally attached to each stiffener 19 is a handle 8 which can be used to pull the scroll type screen 17 downward. A short bunge cord 16 or similar attachment means may be attached to the handle 8 at one end and to the integrally molded hook 13 on the hollow base member 2 at the other end holding the two side screens in the fully closed position. The screen received within the perpendicular tubular section 6C may be similarly held in place by attaching the cord to the horizontal cross support member 11.

Also contained within each tubular section 6A, 6B and 6C is a stop catch 20 and spring mechanism 21 used in connection with a spring loaded rod. These mechanisms allow the spring loaded screens 17 to function similarly to a household window shade or blind. This mechanism is not shown or described in great detail since these types of screens or shades are generally known in the prior art. A side of the screen may contain any one of an unlimited number of decorative designs or prints 18.

A plurality of clothes lines 12 are attached substantially in parallel to the bottom frame 10 using S-hooks or other convenient attachment means 23. From the above descriptions, it is now apparent that the new invention provides a new and improved mini clothes line which is easier to erect and anchor and which has self-contained privacy screens. Alternatively, the base members may have rollers or other similar transport means attached thereto allowing the device to be easily transported short distances without having to disassemble the device. It is understood that although there has been shown and described the preferred embodiment of the above described invention that modifications may be made to the invention which do not exceed the scope of the appended claims. Accordingly the scope of my invention is to be limited only by the following claims:

I claim:

1. An enclosable clothes line assembly comprising:

a pair of substantially hollow L-shaped base members each having an interior chamber including a substantially flat horizontal portion with an upwardly extending portion vertically depending therefrom each having a first aperture at a distal end;

a pair of leg members vertically each received within a respective first aperture on said upwardly extending portions;

an upper frame component secured to said leg members, said frame component including two parallel sides and a third side perpendicularly disposed therebetween;

a substantially square bottom frame attached to the upper frame component and to said legs with the upper frame superimposed thereon;

a plurality of clothes lines each having a pair of opposing ends a first of which is attached to a side of the bottom frame and a second of which is attached to an opposing side of the bottom frame.

2. A clothes line assembly according to claim 1 further comprising:

a selectively extendable enclosure means scrollably received within the upper frame component to visibly conceal clothes hanging on said clothes lines.

3. A clothes line assembly according to claim 1 further comprising an aperture on the upper surface of each flat horizontal portion in communication with the base component interior chamber;

a cap member removably received within said aperture for selectively filling said interior chambers with a weighted substance such as fluid or sand.

4. A clothes line assembly according to claim 2 wherein said selectively extendable enclosure means comprises a scroll type, spring loaded screen extendable from and retractable within each side of said upper frame component.

5. A clothes line assembly according to claim 4 wherein each base member further includes a hook integral with its horizontal portion.

6. A clothes line assembly according to claim 5 wherein each spring loaded screen has a handle at a distal edge which may be grasped by a user.

7. A clothes line assembly according to claim 4 wherein said screens have a decorative design on a side thereof.

8. A clothes line assembly according to claim 6 further comprising a cross support member horizontally disposed between said legs to provide stability thereto.

9. A clothes line assembly according to claim 8 further comprising means for securing said screens in an extended position.

10. A clothes line assembly according to claim 9 wherein said means for securing said screens in an extended position comprises an attachment means removably attached to said handle for securing two of said screens to said hooks and a third screen to said cross support member.

* * * * *